US007070065B2

(12) United States Patent
Wong

(10) Patent No.: US 7,070,065 B2
(45) Date of Patent: Jul. 4, 2006

(54) CLOSURE ASSEMBLY FOR DRINKING VESSEL

(75) Inventor: Chung Lun Wong, Tai Kok Tsui (HK)

(73) Assignee: Fu Hong Industries Limited, Kowloon (HK)

( * ) Notice: Subject to any disclaimer, the term of this patent is extended or adjusted under 35 U.S.C. 154(b) by 37 days.

(21) Appl. No.: 10/796,117

(22) Filed: Mar. 10, 2004

(65) Prior Publication Data

US 2005/0199637 A1 Sep. 15, 2005

(51) Int. Cl.
*A47G 19/22* (2006.01)

(52) U.S. Cl. ..... 220/714; 222/482

(58) Field of Classification Search ..... 220/714, 220/717, 705–710, 711, 719, 703, 731, 734; 222/482, 494

See application file for complete search history.

(56) References Cited

U.S. PATENT DOCUMENTS

| | | | | |
|---|---|---|---|---|
| 4,146,157 | A | 3/1979 | Dixon, Sr. et al. | |
| 4,184,604 | A | 1/1980 | Amberg et al. | |
| 4,767,019 | A | 8/1988 | Horner | |
| 5,706,973 | A | 1/1998 | Robbins, III et al. | |
| 5,890,620 | A * | 4/1999 | Belcastro | 220/714 |
| 6,050,445 | A | 4/2000 | Manganiello | |
| 6,102,245 | A | 8/2000 | Haberman | |
| 6,305,570 | B1 | 10/2001 | Atkin et al. | |
| 6,325,236 | B1 | 12/2001 | Wong | |
| 6,568,557 | B1 * | 5/2003 | Fusco et al. | 220/714 |
| 6,616,012 | B1 * | 9/2003 | Dark | 222/1 |
| 6,832,706 | B1 * | 12/2004 | Hearld et al. | 222/494 |
| 2002/0121525 | A1 | 9/2002 | Stillinger et al. | |
| 2004/0011800 | A1 | 1/2004 | Essebaggers | |

FOREIGN PATENT DOCUMENTS

| | | |
|---|---|---|
| GB | 2317 608 | 4/1998 |
| GB | 2333 770 | 8/1999 |
| WO | WO 03/105635 | 12/2003 |
| WO | WO 2004/064578 | 8/2004 |

* cited by examiner

*Primary Examiner*—Lien M. Ngo
(74) *Attorney, Agent, or Firm*—Leydig, Voit & Mayer, Ltd.

(57) ABSTRACT

A closure assembly for a water bottle, having a cap including a mouthpiece that has a first aperture through which water in the bottle can flow out upon the application of suction at the mouthpiece. A support inside the mouthpiece has at least one second aperture that, together with the first aperture, defines a path for water. Also included is a valve member that has a diaphragm located between the mouthpiece and the support. The diaphragm has an aperture in the path and bears resiliently against the support when no suction is applied to the mouthpiece, so its aperture is closed, blocking the path. Upon the application of suction at the mouthpiece, the diaphragm is deformed and moves away from the support so the aperture in the diaphragm is opened to permit the flow of water.

19 Claims, 2 Drawing Sheets

CLOSURE ASSEMBLY FOR DRINKING VESSEL

The present invention relates to a closure assembly for a drinking vessel, and particularly but not exclusively to an infants' trainer cup or sport water bottle, which is leak-proof.

BACKGROUND OF THE INVENTION

Leak-proof drinking devices have generally been known particularly for infants and sports, which usually have a body and a lid or cap closing the body. In the typical construction, for example as disclosed in UK Patent No. 2266045, the lid has an outlet for liquid and an air inlet for pressure balance, each of which is fitted with a normally-closed one-way valve to avoid leakage.

In general, some of the known devices incorporate relatively complicated mechanisms with small parts and, on occasion, metal springs, which are expensive and not easy to clean. Most of the other designs make use of a thin membrane at the base of a protruding mouthpiece, which includes a slit or opening to provide a passage for liquid and, while the opening is closed, to prevent leakage of liquid. In case of vigorous liquid movement inside the cup (e.g., shaking or dropping), liquid can easily leak out upon directly hitting the slit or the membrane. Liquid flow rate is usually inadequate, as it is often compromised by the leak-proof requirement. None of the known devices is found to be satisfactory in one or more of these areas.

The invention seeks to mitigate or at least alleviate at least some of these drawbacks by providing an improved closure assembly.

SUMMARY OF THE INVENTION

According to the invention, there is provided a closure assembly for use at the opening of a drinking vessel, comprising a cap including a hollow mouthpiece protruding therefrom and having a first aperture at its free end through which liquid in said vessel can flow out upon suction at the mouthpiece. A support provided inside the mouthpiece has at least one second aperture that in conjunction with the first aperture define a path for said flow of liquid. Also included is a valve member that comprises a resiliently deformable diaphragm located between the mouthpiece and the support. The diaphragm has an aperture in the path and normally bears resiliently against the support to have its aperture closed by the support thereby blocking the path. The arrangement is such that upon suction at the mouthpiece the diaphragm is deformed under pressure away from the support to have its aperture opened to thereby permit said flow of liquid.

Preferably, the diaphragm has a part that normally bears resiliently against and thus closes the second aperture, and the second aperture is opened when the diaphragm is deformed to have its aperture opened.

Preferably, the diaphragm is concave and the support has a concave part in which the diaphragm is located and resiliently against which the diaphragm normally bears.

More preferably, the diaphragm aperture is positioned centrally of the diaphragm, and the support part includes at its periphery a plurality of said second apertures surrounding the diaphragm aperture.

It is preferred that the diaphragm is located by the support at a position immediately behind the mouthpiece aperture.

In a preferred embodiment, the support is hollow and is positioned co-axially inside the mouthpiece, each having an upper end including the respective aperture.

More preferably, the valve member includes a sleeve closed at one end that provides the diaphragm, the sleeve being compressed between the mouthpiece and the support.

Further more preferably, the valve member is mounted on and encloses the support.

It is preferred that the support includes a peripheral flange outside the mouthpiece and engageable with the cap for locating the apertured part of the support inside the mouthpiece.

It is preferred that the cap includes at least one breather hole, and the valve member includes a resiliently deformable part which normally bears resiliently against and thus closes the breather hole and upon suction at the mouthpiece is deformed under pressure away from the breather hole to open it to thereby equalise pressure across opposite sides of the diaphragm.

According to a slightly different aspect of the invention, there is provided a closure assembly for use at the opening of a drinking vessel, comprising a cap including a mouthpiece protruding therefrom and having a first aperture at its free end through which liquid in said vessel can flow out upon suction at the mouthpiece. A support provided inside the mouthpiece has at least one second aperture to permit said flow of liquid. Also included is a valve member that comprises a resiliently deformable diaphragm located between the mouthpiece and the support, which is apertured and is disposed between the first and the second apertures and normally bears resiliently against the support to have its aperture closed by the support. The arrangement is such that upon suction at the mouthpiece the diaphragm is deformed under pressure away from the support to have its aperture opened to thereby permit said flow of liquid through also the first and second apertures.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
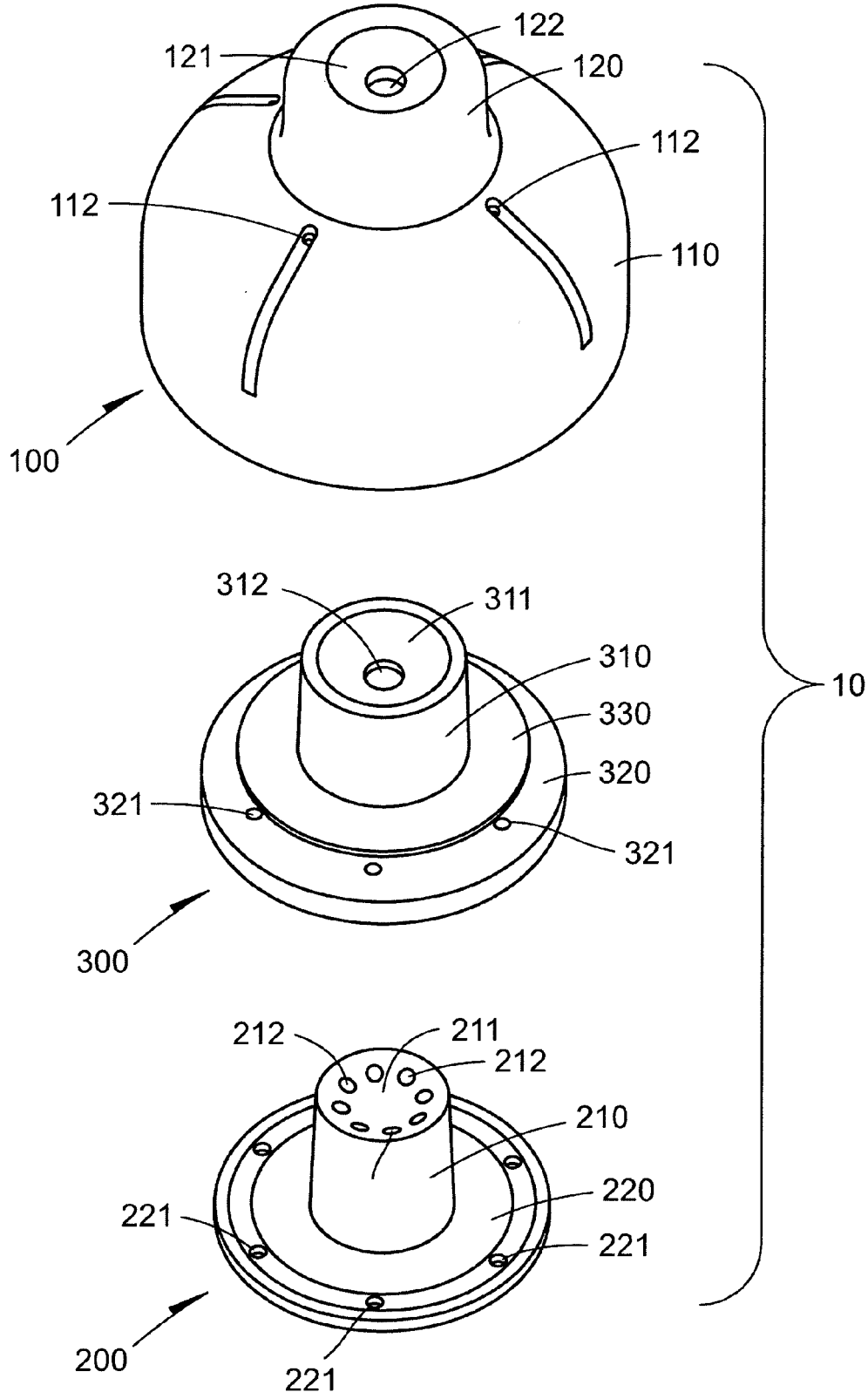
FIG. 1 is an exploded perspective view of an embodiment of a closure assembly in accordance with the invention for a drinking vessel, including a mouthpiece.
Figure 2:
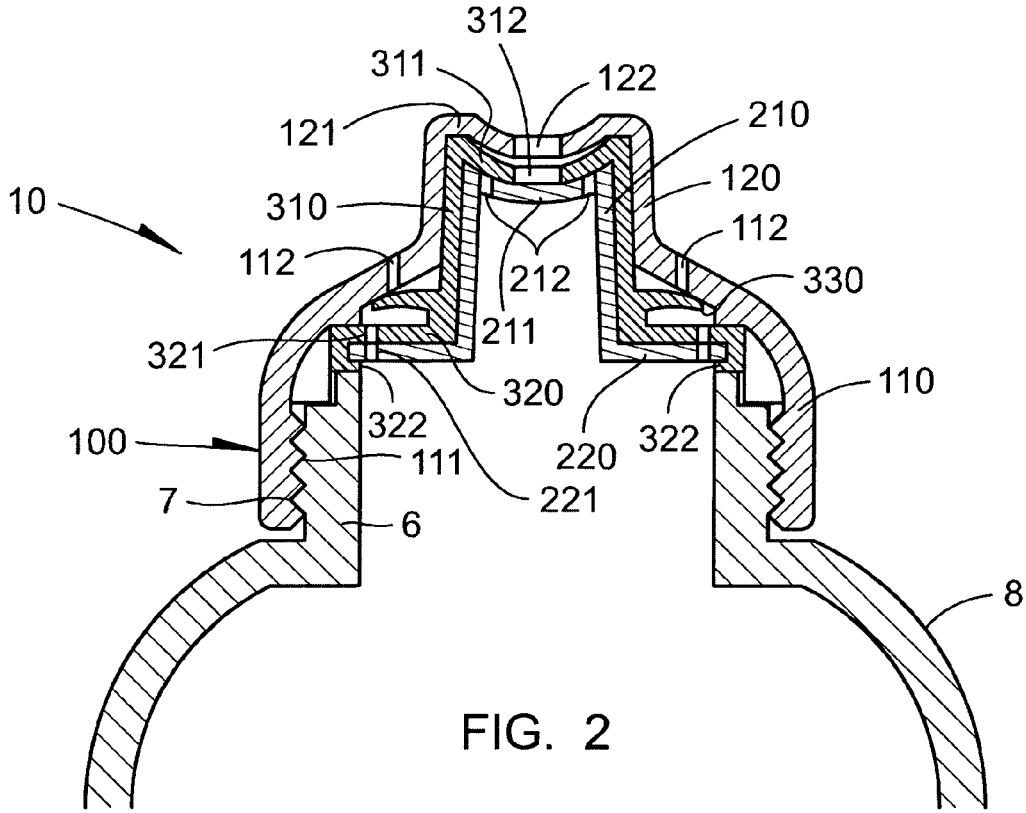
FIG. 2 is a cross-sectional side view of the closure assembly of FIG. 1 closing a drink vessel, with the mouthpiece being normally-closed.
Figure 3:
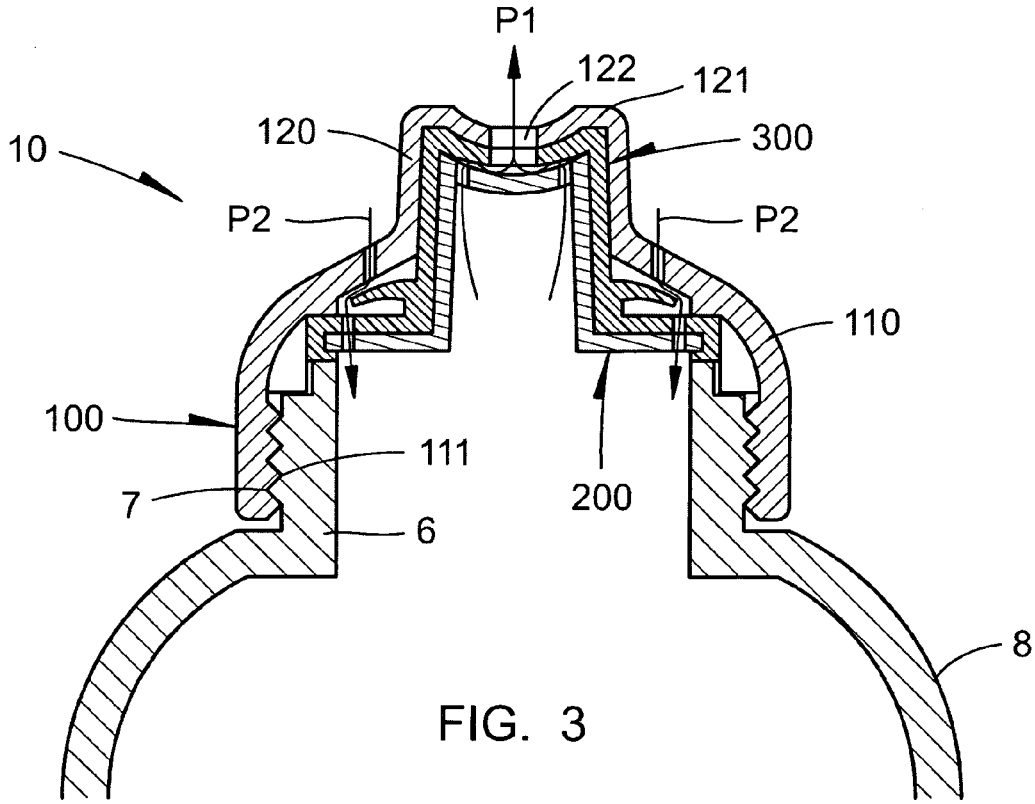
FIG. 3 is a cross-sectional side view corresponding to FIG. 2, with the mouthpiece being opened upon suction thereat.

Referring to the drawings, there is shown a closure assembly 10 embodying the invention for use at an opening 6 of a drinking vessel such as a water bottle 8, which assembly 10 comprises a plastics cap 100 and a plastics core 200 and silicon rubber valve member 300 both located inside the cap 100. The cap 100 has a generally hemispherical base 110 and a generally cylindrical central mouthpiece 120 protruding integrally and upwardly therefrom. The base 110 has internal screw-threads 111 at its bottom for screwing onto the bottle opening or neck 6 that includes external screw-threads 7.

The mouthpiece 120 is hollow, having an upper free end wall 121 that is slightly curved in or concave and includes a central aperture 122 through which water (or drink) in the bottle 8 can flow out upon application of suction at the mouthpiece 120. The base 110 includes four small breather holes 112 formed equiangularly around and close to the mouthpiece 120.

The core 200 has a generally cylindrical hollow body 210 and an annular base flange 220 extending integrally around the body 210. The body 210 is to be positioned co-axially inside the mouthpiece 120, including a slightly concave upper end wall 211 that has eight equiangular peripheral apertures 212 to permit the aforesaid flow of water. These core apertures 212 in conjunction with the mouthpiece aperture 122 define a path P1 for the water flow. The base flange 220 has six equiangular small holes 221 along its periphery.

The valve member 300 has a similar hollow basic structure as the core 200, i.e. a generally cylindrical sleeve 310 closed at its upper end that provides the diaphragm 311 and an annular integral base flange 320. The valve member 300 has shape and size matching with that of the core 200 such that it can easily be and is mounted on and encloses the core 200.

The sleeve 310 has a slightly concave upper end wall that acts as a diaphragm 311. The diaphragm 311 includes a central aperture 312 that is aligned with the mouthpiece aperture 122 and surrounded by the core apertures 212, being positioned in the path P1. There is an annular flange flap 330, which extends horizontally around the valve member sleeve 310 at a position immediately above the base flange 320.

The base flange 320 has a periphery that turns in or is folded back on the bottom side and embraces the periphery of the core base flange 220, whereby the valve member 300 is fixedly mounted on the core 200. The base flange 320 includes, along its periphery, six equiangular small holes 321 that are aligned with the base flange holes 221 of core 220.

The three pieces 100 to 300 can easily be taken apart to facilitate cleaning of the closure assembly 10. For use, the valve member 300 is first mounted on the core 200 and they are then placed inside the cap 100. Upon screwing of the cap 100 onto the bottle neck 6, the core 200 with the valve member 300 will be fixed in position by the edge of their combined flange 220/320 being clamped between the cap 100 and the rim of the bottle neck 6.

In the assembled condition of the closure assembly 10, the core 200 with the valve member 300 mounted thereon is positioned co-axially inside the cap 100, with the valve member flap 330 resiliently bearing against the breather holes 112 and thus normally sealing off the same. The three cylindrical parts 120, 210 and 310 have diameters such that the valve member sleeve 310 is tightly clamped or compressed by and between the mouthpiece 120 and the core body 210. At their upper ends, the mouthpiece wall 121 and the core wall 211 define a thin cavity that is just sufficiently thick to allow the diaphragm 311 therein to flex up and down to a limited extent, at a position immediately behind the mouthpiece aperture 122.

The diaphragm 311 is in itself preferably relatively thick, and by virtue of resilience it normally presses flat on and tight against the core end wall 211. This leads to a closed condition of the mouthpiece 120, in that the diaphragm aperture 312 is sealed off by the central portion of the core end wall 211 thereby blocking the path P1 and, simultaneously, the core end wall apertures 212 are sealed off by the peripheral portion of the diaphragm 311. Thus, both sets of apertures 312 and 212 are closed to enhance the leak-proof effect.

In operation, application of suction at the mouthpiece 120 creates a pressure drop outside the diaphragm 311, which causes the diaphragm 311 to flex under pressure slightly upwards from the core end wall 211, whereby their apertures 312 and 212 become unblocked. The path P1 through these apertures 312 and 212 is thus opened up, along which water in the bottle 8 can be sucked out while the bottle 8 is turned upside down.

Simultaneously, the pressure drop causes the valve member flap 330 to bend away from the breather holes 112. This opens up another path P2 through the breather holes 112 past the aligned flange holes 221 and 321 for air to be drawn in to balance or equalize the pressure inside the bottle 8 with the atmospheric pressure across opposite sides of the diaphragm 311. Upon stopping of suction, the diaphragm 311 and the flap 330 return to their original sealing positions by virtue of resilience to thereby shut off both the mouthpiece 120 and the breather holes 112.

The core end wall 211 acts as a valve seat for the diaphragm 311, which together function as a normally-closed one-way valve for the liquid content. The valve member flap 330 also acts as a normally-closed non-return valve for air upon the breather holes 112. Both valves are pressure sensitive and open under suction.

While the aforesaid one-way valve 211/311 is closed, as sealing is accomplished between two abutting surfaces, i.e. those at the interface between the core end wall 211 and the diaphragm 311, the seal at the mouthpiece 120 is very effective and is leak-proof even if the bottle 8 is handled roughly or under vigorous movement.

Both sets of apertures 312 and 212 are closed to enhance the leak-proof effect. As sealing of the said one-way valve 211/311 (associated with the aperture 312) is effected on the outer side of the core end wall 211, the liquid contained inside the bottle 8 is blocked from hitting the seal or the aperture 312 directly, whereby leakage is more unlikely to occur.

Given the construction, the diaphragm aperture 312 can be made relatively large and there can be more than one or several core member apertures 212 (eight in the described embodiment), liquid can be withdrawn by suction at an adequately high flow rate.

As sealing at the mouthpiece 120 is done right behind its aperture 122, only a very small amount of liquid will be left in the mouthpiece 120 while it is shut, thereby permitting practically no remainder liquid in the mouthpiece 120 for leakage.

The invention has been given by way of example only, and various modifications of and/or alterations to the described embodiments may be made by persons skilled in the art without departing from the scope of the invention as specified in the appended claims.

What is claimed is:

1. A closure assembly for an opening of a drinking vessel, comprising:

a cap including a hollow mouthpiece protruding from the cap and having a first aperture at a free end of the mouthpiece through which liquid in the vessel can flow out upon application of suction to the mouthpiece;

a support located inside the mouthpiece and having at least one second aperture that, in conjunction with the first aperture, defines a path for flow of the liquid out of the vessel; and a valve member comprising a resiliently deformable diaphragm located between the mouthpiece and the support, the diaphragm having a third aperture in the path and normally bearing resiliently against the support to close the third aperture with the support and to close the second aperture with the diaphragm, thereby blocking the path, wherein, upon the application of suction at the mouthpiece, the diaphragm is deformed and moves away from the support so that the second and third apertures are opened to permit the flow of the liquid out of the vessel.

2. The closure assembly as claimed in claim 1, wherein the diaphragm is concave and the support has a concave part in which the diaphragm is received and against which the diaphragm resiliently bears when suction is not applied at the mouthpiece.

3. The closure assembly as claimed in claim 2, wherein the third aperture is positioned centrally in the diaphragm, and the support part includes, at a periphery, a plurality of the second apertures, surrounding the third aperture.

4. The closure assembly as claimed in claim 1, wherein the diaphragm is located by the support at a position immediately behind the first aperture.

5. The closure assembly as claimed in claim 1, wherein the support is hollow and is positioned co-axially inside the mouthpiece, each of the support and the mouthpiece having a protruding end including the second and first apertures, respectively.

6. The closure assembly as claimed in claim 5, wherein the valve member includes a tubular sleeve partially closed at an end, the end being the diaphragm, and the sleeve being located between the mouthpiece and the support.

7. The closure assembly as claimed in claim 6, wherein the support includes a tubular portion and the sleeve of the valve member is mounted on and encloses the tubular portion of the support.

8. The closure assembly as claimed in claim 5, wherein the support includes a peripheral flange located in the cap, outside the mouthpiece, and engageable with the cap for locating the part of the support including the second aperture inside the mouthpiece.

9. The closure assembly as claimed in claim 1, wherein the cap includes at least one breather hole, and the valve member includes a resiliently deformable flange which normally bears resiliently against and closes the breather hole and, upon the application of suction at the mouthpiece, the resiliently deformable flange is deformed and moves away from the breather hole, opening the breather hole to equalize pressure at opposite sides of the resiliently deformable flange.

10. A closure assembly for an opening of a drinking vessel, comprising:

a cap having a hollow mouthpiece protruding from the cap and having a first aperture at a free end of the mouthpiece through which liquid in the vessel can flow out upon application of suction to the mouthpiece;

a generally tubular support located inside the mouthpiece and having an end including at least one second aperture that, in conjunction with the first aperture, defines a path for flow of the liquid out of the vessel; and a generally tubular valve member comprising a sleeve mounted on the support, between the support and the mouthpiece, and having a resiliently deformable diaphragm at one end, the diaphragm being located between the mouthpiece and the support and having a third aperture in the path, the diaphragm normally bearing resiliently against the support to close the third aperture with the support and to close the second aperture with the diaphragm, thereby blocking the path, wherein, upon the application of suction at the mouthpiece, the diaphragm is deformed and moves away from the support so that the second and third aperture s are open to permit the flow of the liquid out of the vessel.

11. The closure assembly as claimed in claim 10, wherein the cap includes at least one breather hole, and the valve member includes a peripheral resiliently deformable flange extending from the sleeve, the resiliently deformable flange normally bearing resiliently against and closing the breather hole and, upon the application of suction at the mouthpiece, the resiliently deformable flange is deformed and moves away from the breather hole, opening the breather hole to equalize pressure at opposite sides of the resiliently deformable flange.

12. The closure assembly a claimed in claim 11, wherein the support includes a relatively rigid peripheral flange located within the cap and outside the mouthpiece, the valve member includes a base peripherally extending from the sleeve, the resiliently deformable flange being disposed intermediate the diaphragm and the base, and the peripheral flange of the support supports the base of the valve member within the cap.

13. The closure assembly as claimed in claim 12 wherein the base of the valve member and the peripheral flange of the support include at least one aligned hole providing fluid communication from outside the vessel to inside the vessel through the breather hole when the resiliently deformable flange moves away from the breather hole.

14. The closure assembly as claimed in claim 10, wherein the diaphragm is concave and the support has a concave part in which the diaphragm is received and against which the diaphragm resiliently bears when suction is not applied at the mouthpiece.

15. The closure assembly as claimed in claim 14, wherein the third aperture is positioned centrally in the diaphragm, and the support part includes at a periphery a plurality of the second apertures, surrounding the third aperture.

16. The closure assembly as claimed in claim 10, wherein the diaphragm is located by the support at a position immediately behind the first aperture.

17. The closure assembly as claimed in claim 10, wherein the support is positioned co-axially inside the mouthpiece, each of the support and the mouthpiece having a protruding end including the second and third apertures, respectively.

18. The closure assembly as claimed in claim 12, wherein the base of the valve member includes an internal groove receiving an outer edge of the peripheral flange and for engaging a rim of the vessel.

19. The closure assembly as claimed in claim 9, wherein the support includes a relatively rigid peripheral flange located within the cap and outside the mouthpiece, the valve member includes a peripherally extending base, the resiliently deformable flange being disposed intermediate the diaphragm and the base, the peripheral flange of the support supports the base of the valve member within the cap, and the base of the valve member and the peripheral flange of the support include at least one aligned hole providing fluid communication from outside the vessel to inside the vessel through the breather hole when the resiliently deformable flange moves away from the breather hole.

* * * * *